US006145629A

United States Patent [19]

Addy

[11] Patent Number: 6,145,629

[45] Date of Patent: Nov. 14, 2000

[54] METHOD AND APPARATUS FOR OPERATING A SELF-SERVICE CHECKOUT TERMINAL WHICH HAS A SINGLE WEIGHT SCALE FOR PERFORMING BOTH AN ITEMIZATION AND A SECURITY FUNCTION

[75] Inventor: John C. Addy, Lawrenceville, Ga.

[73] Assignee: NCR Corporation, Dayton, Ohio

[21] Appl. No.: 09/257,741

[22] Filed: Feb. 25, 1999

[51] Int. Cl.[7] ..... A47F 9/04

[52] U.S. Cl. ..... 186/61; 235/383

[58] Field of Search ..... 186/61; 235/383

[56] References Cited

U.S. PATENT DOCUMENTS

| | | | |
|---|---|---|---|
| 4,964,053 | 10/1990 | Humble | 186/61 X |
| 5,115,888 | 5/1992 | Schneider | 186/61 |
| 5,125,465 | 6/1992 | Schneider | 186/61 X |

*Primary Examiner*—F. J. Bartuska
*Attorney, Agent, or Firm*—Maginot, Addison & Moore

[57] ABSTRACT

A method of operating a self-service checkout terminal having a weight scale associated therewith includes the step of generating an item-entered control signal when a user enters a first item for purchase with a code entry device. The method also includes the step of monitoring output from the weight scale in response to generation of the item-entered control signal and generating an entered-item-detected control signal if the weight scale detects that the user placed the first item for purchase in a shopping container. In addition, the method includes the step of operating the self-service checkout terminal so as to allow the user to enter subsequent items for purchase in response to generation of the entered-item-detected control signal. Moreover, the method includes the step of generating a unentered-item-detected control signal if the weight scale detects that the user placed a second item for purchase in the shopping container without having entered the second item for purchase into the self-service checkout terminal. Yet further, the method includes the step of operating the self-service checkout terminal so as to allow the user to enter the second item for purchase into the self-service checkout terminal in response to generation of the unentered-item-detected control signal. A self-service checkout terminal is also disclosed.

15 Claims, 5 Drawing Sheets

METHOD AND APPARATUS FOR OPERATING A SELF-SERVICE CHECKOUT TERMINAL WHICH HAS A SINGLE WEIGHT SCALE FOR PERFORMING BOTH AN ITEMIZATION AND A SECURITY FUNCTION

TECHNICAL FIELD OF THE INVENTION

The present invention relates generally to a retail terminal, and more particularly to a method and apparatus for operating a self-service checkout terminal having a single weight scale for performing both an itemization and a security function.

BACKGROUND OF THE INVENTION

In the retail industry, the largest expenditures are typically the cost of the goods sold followed closely by the cost of labor expended. With particular regard to the retail grocery or supermarket industry, the impetus to reduce labor costs has focused on reducing or eliminating the amount of time required to handle and/or process the items or goods to be purchased by a customer. To this end, there have been a number of self-service checkout terminal concepts developed which attempt to substantially eliminate the need for a checkout clerk.

A self-service checkout terminal is a system which is operated by a customer without the aid of a checkout clerk. In such a system, the customer scans individual items for purchase across a scanner and then places the scanned item into a grocery bag, if desired. The customer then pays for his or her purchase either at the self-service checkout terminal if so equipped, or at a central payment area which is staffed by a store employee. Thus, a self-service checkout terminal permits a customer to select, itemize, and in some cases pay for his or her items for purchase without the assistance of the retailer's personnel.

A customer typically has little or no training in the operation of a self-service checkout terminal prior to his or her initial use of the checkout terminal. One concern that retailers have when evaluating a self-service checkout terminal is the level of supervision provided to inexperienced customers. Moreover, it is also known that some customers may have improper intentions when using a self-service checkout terminal. In traditional checkout systems, the clerk employed by the retailer to operate the checkout terminal provides a level of security against theft or other improprieties. However, in the case of a self-service checkout terminal, the terminal itself must provide the necessary security. Hence, self-service checkout terminals which have heretofore been designed typically include a security system which provides a level of security against theft or other improprieties.

One such security system which has been utilized in previously designed self-service checkout systems includes an item sensor such as a weight scale which is positioned to detect the insertion or removal of items into and out of a shopping container such as a grocery bag. Monitoring such insertion and removal of items from a grocery bag is particularly useful in situations such as determining if a customer inserts an item into a grocery bag without having first scanned the item. Hence, self-service checkout terminals utilizing such a security system typically have two separate weight scales. In particular, in addition to the security weight scale utilized to detect insertion or removal of items into and out of a grocery bag, a product weight scale is provided to weigh items such as produce items which are sold based on weight thereof during the itemization process. More specifically, the product weight scale is generally a certified weight scale which is provided to weigh a produce item or the like such that the weight value of the item may be utilized in order to calculate the price that the customer must pay for the item.

However, self-service checkout terminals including such a security system have a number of drawbacks associated therewith. For example, use of two separate weight scales is inherently expensive thereby increasing costs associated with manufacture of the self-service checkout terminal. Moreover, having separate weight scales may potentially reduce the efficiency or throughput associated with operation of the self-service checkout terminal by the customer. For example, in the case of a produce item or the like, the customer must first place the produce item on the product weight scale so as to enter the produce item into the terminal, and thereafter remove the produce item from the product weight scale and place the produce item in a shopping bag so as to be detected by the security weight scale.

What is needed therefore is a self-service checkout terminal which overcomes one or more of the above-mentioned drawbacks. What is particularly needed is a self-service checkout terminal which utilizes a single weight scale to perform both an itemization function and a security function. What is also particularly needed is a self-service checkout terminal which provides for enhanced efficiency and throughput during operation thereof by a customer.

SUMMARY OF THE INVENTION

In accordance with a first embodiment of the present invention, there is provided a method of operating a self-service checkout terminal having a weight scale associated therewith. The method includes the step of detecting placement of an entered item for purchase into a shopping container with the weight scale and generating an entered-item-detected control signal in response thereto. The method also includes the step of operating the self-service checkout terminal so as to allow a user to enter subsequent items for purchase in response to generation of the entered-item-detected control signal. The method further includes the step of detecting placement of an unentered item for purchase into the shopping container with the weight scale and generating an unentereditem-detected control signal in response thereto. Moreover, the method includes the step of operating the self-service checkout terminal so as to allow the user to enter the unentered item for purchase into the self-service checkout terminal in response to generation of the unentered-item-detected control signal.

In accordance with a second embodiment of the present invention, there is provided a method of operating a self-service checkout terminal having a weight scale associated therewith. The method includes the step of generating an item-entered control signal when a user enters a first item for purchase with a code entry device. The method also includes the step of monitoring output from the weight scale in response to generation of the item-entered control signal and generating an entered-item-detected control signal if the weight scale detects that the user placed the first item for purchase in a shopping container. In addition, the method includes the step of operating the self-service checkout terminal so as to allow the user to enter subsequent items for purchase in response to generation of the entered-item-detected control signal. Moreover, the method includes the step of generating a unentered-item-detected control signal if the weight scale detects that the user placed a second item for purchase in the shopping container without having entered the second item for purchase into the self-service checkout terminal. Yet further, the method includes the step of operating the self-service checkout terminal so as to allow the user to enter the second item for purchase into the self-service checkout terminal in response to generation of the unentered-item-detected control signal.

In accordance with a third embodiment of the present invention, there is provided a self-service checkout terminal. The self-service checkout terminal includes a weight scale for detecting placement of both an entered item for purchase and an unentered item for purchase into a shopping container. The self-service checkout terminal also includes a processing unit electrically coupled to the weight scale. Moreover, the self-service checkout terminal includes a memory device electrically coupled to the processing unit. The memory device has stored therein a plurality of instructions which, when executed by the processing unit, causes the processing unit to (a) detect placement of the entered item for purchase into the shopping container with the weight scale and generate an entered-item-detected control signal in response thereto, (b) operate the self-service checkout terminal so as to allow a user to enter subsequent items for purchase in response to generation of the entered-item-detected control signal, (c) detect placement of the unentered item for purchase into the shopping container with the weight scale and generate an unentered-item-detected control signal in response thereto, and (d) operate the self-service checkout terminal so as to allow the user to enter the unentered item for purchase into the self-service checkout terminal in response to generation of the unentered-item-detected control signal.

It is therefore an object of the present invention to provide a new and useful method and apparatus of operating a self-service checkout terminal.

It is moreover an object of the present invention to provide an improved method and apparatus for operating a self-service checkout terminal.

It is also an object of the present invention to provide a self-service checkout terminal which has a lower cost of manufacture relative to self-service checkout terminals which have heretofore been designed.

It is yet another object of the present invention to provide a self-service checkout terminal which provides for enhanced efficiency and throughput during operation thereof by a customer.

The above and other objects, features, and advantages of the present invention will become apparent from the following description and the attached drawings.

DETAILED DESCRIPTION OF THE INVENTION

Figure 1:
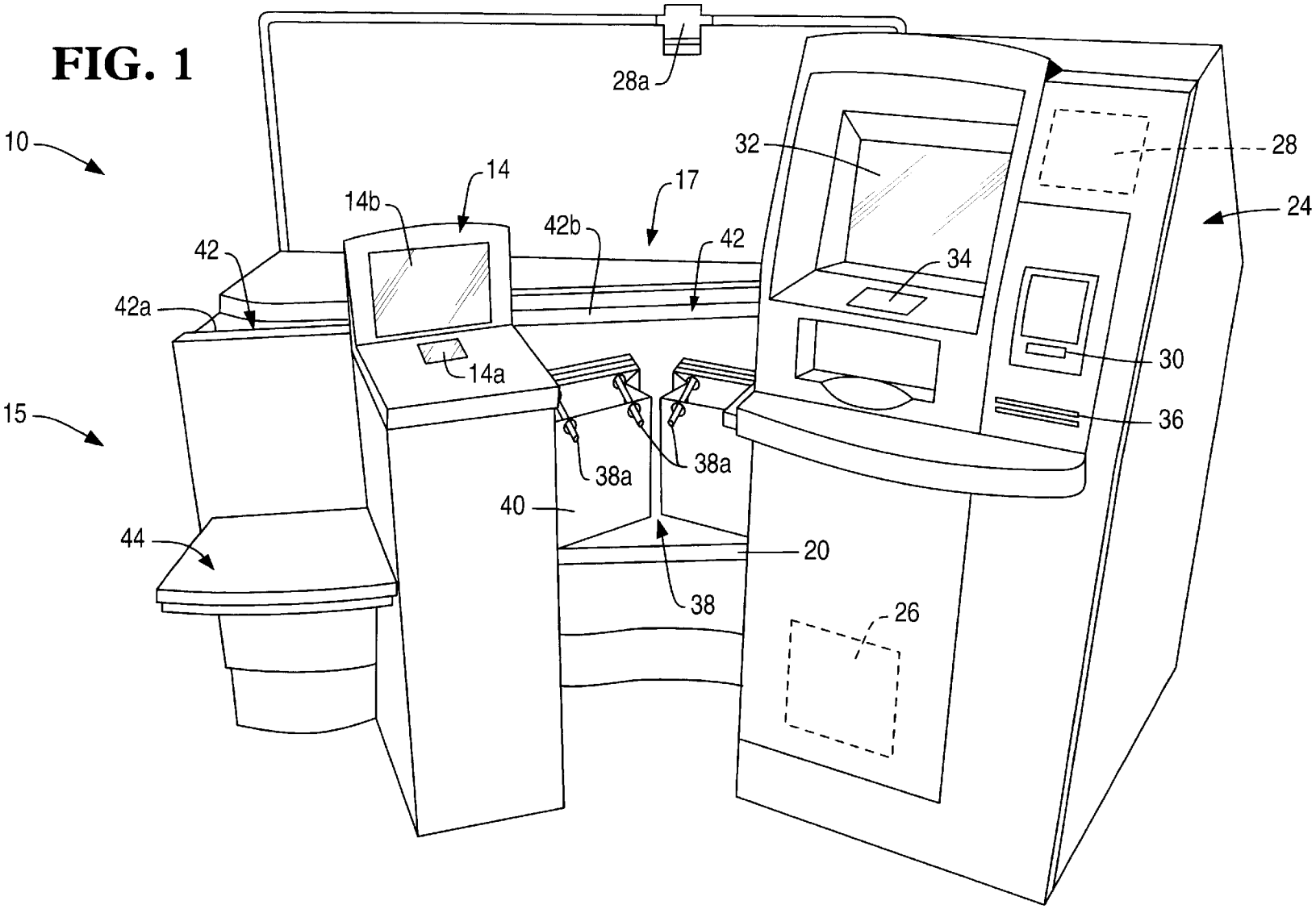
FIG. 1 is a perspective view of a self-service checkout terminal which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
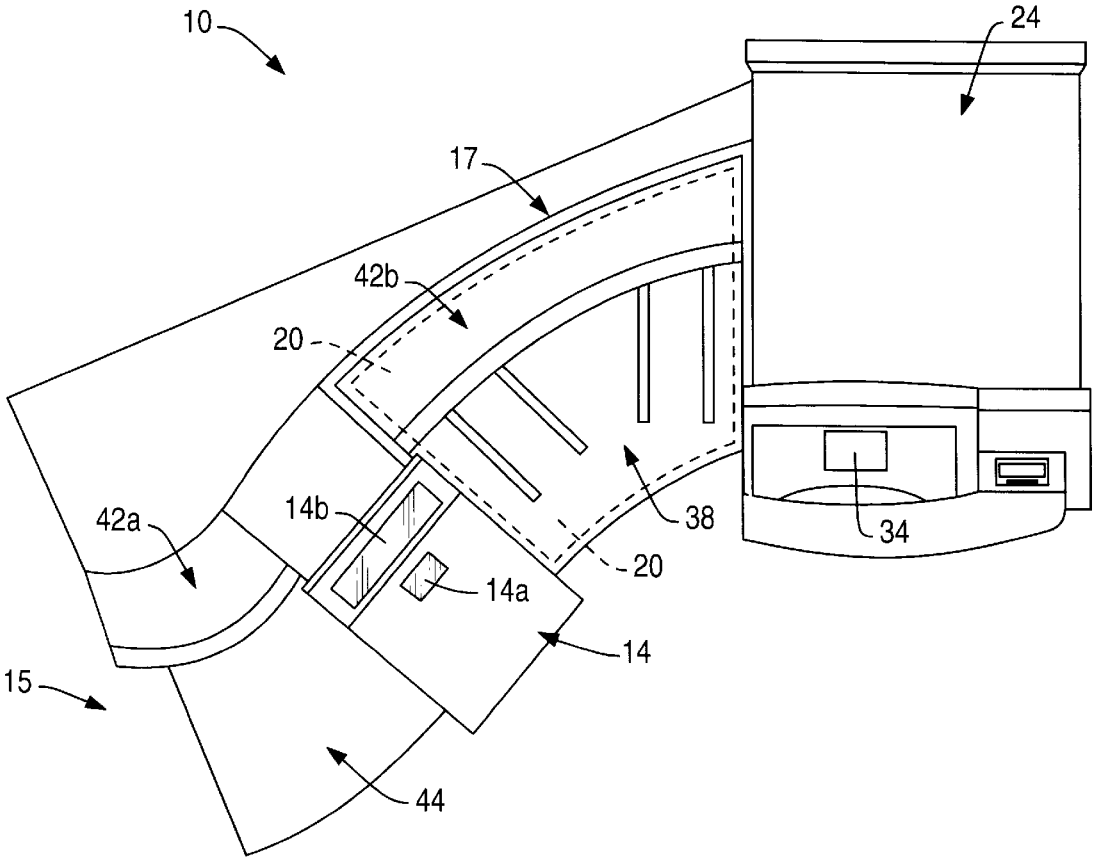
FIG. 2 is a plan view of the self-service checkout terminal of FIG. 1.

Referring now to FIGS. 1 and 2, there is shown a self-service checkout terminal 10 for use in a retail business such as a grocery store. The self-service checkout terminal 10 includes a scanner 14, an itemization/security weight scale 20, an automated teller machine (ATM) 24, and a processing unit 26. The ATM 24 includes a video system 28, a card reader 30, a display monitor 32, a keypad 34, and a printer 36.

The self-service checkout terminal 10 also includes a bagwell 38 for accommodating one or more shopping containers such as grocery bags 40, a counter 42, and a basket shelf 44. The counter 42 defines an arcuate surface as shown in FIG. 2. Such an arcuate surface allows the counter 42 to be positioned relatively close to both the scanner 14 and the bagwell 38 thereby permitting the counter 42 to function as a "set-aside surface" for use by the user or customer during operation of the self-service checkout terminal 10. Such set-aside surfaces are necessary to allow the customer to selectively choose the order in which items are scanned or otherwise entered. Moreover, such set-aside surfaces are necessary to allow a customer to selectively choose the order in which items are loaded into the grocery bags 40. For example, if the customer scanned a loaf of bread, the customer may wait to load the bread into the grocery bag 40 until the bag is nearly full thereby preventing the bread from being crushed. As alluded to above, it may be desirable to use the set-aside surfaces both before and after an item has been scanned or otherwise entered. Hence, as shown in FIG. 2, the scanner 14 divides the counter 42 into a upstream set-aside shelf 42*a*, and a downstream setaside shelf 42*b*. In particular, the scanner 14 divides the counter 42 into the upstream set-aside shelf 42*a* which is upstream of the scanner 14, and the downstream set-aside shelf 42*b* which is downstream from the scanner 14. The terms "upstream" and "downstream" are used to be consistent with the flow of items through the self-service checkout terminal 10 during a typical checkout procedure. In particular, an item enters at the area proximate the upstream set-aside shelf 42*a* then flows in a downstream direction to be scanned at the scanner 14 so as to enter a product identification code associated with the item. Once the product identification code associated with the item is entered, the item flows from the scanner 14 in a downstream direction to the downstream set-aside shelf 42*b* or the bagwell 38.

The bagwell 38 is disposed between the scanner 14 and the ATM 24 as shown in FIG. 1. The bagwell 38 includes a number of posts 38*a* which cooperate to support a number of the grocery bags 40. The bagwell 38 is configured to allow two or more grocery bags 40 to be accessed by the customer at any given time. In particular, the posts 38*a* are of a sufficient length to secure a number of unopened grocery bags 40 along with two or more opened grocery bags 40 thereby allowing a customer to selectively load various item types into the grocery bags 40. For example, the customer may desire to use a first grocery bag 40 for household chemical items such as soap or bleach, and a second grocery bag 40 for edible items such as meat and produce.

The scanner 14 conventionally scans or reads a product identification code such as a Universal Product Code (UPC), industrial symbol(s), alphanumeric character(s), or other indicia associated with an item to be purchased. The scanner 14 includes a first scanning window 14*a* and a second scanning window 14*b*. The first scanning window 14*a* is disposed in a substantially horizontal manner, whereas the second scanning window 14*b* is disposed in a substantially vertical manner, as shown in FIG. 1.

The scanner 14 also includes a light source (not shown) such as a laser, a rotating mirror (not shown) driven by a motor (not shown), and a mirror array (not shown). In operation, a laser beam reflects off the rotating mirror and mirror array to produce a pattern of scanning light beams. As the product identification code on an item is passed over the scanner 14, the scanning light beams scatter off the code and are returned to the scanner 14 where they are collected and detected. The reflected light is then analyzed electronically in order to determine whether the reflected light contains a valid product identification code pattern. If a valid code pattern is present, the product identification code is then converted into pricing information which is then used to determine the cost of the item in a known manner.

The self-service checkout terminal 10 also includes an upstream area 15. What is meant herein by the term "upstream area" is the area associated with the self-service checkout terminal 10 in which items may be placed prior to being scanned or otherwise entered into the self-service checkout terminal 10. For example, the upstream area 15 includes the upstream set-aside shelf 42*a* and the basket shelf 44. Moreover, it should be appreciated that the upstream area 15 may also include the area proximate the terminal 10 in which a shopping cart is positioned prior to the unloading of items therefrom.

The itemization/security weight scale 20 is positioned in order to determine the weight of an item or items positioned (1) on the downstream set-aside shelf 42*b*, and/or (2) in the bagwell 38 (i.e. into one of the grocery bags 40). In particular, if a customer places an item on the downstream set-aside shelf 42*b* or into one of the grocery bags 40, the itemization/security weight scale 20 may be used to determine the weight value of the item by detecting a weight increase associated with placement of the item on the downstream set-aside shelf 42*b* or into one of the grocery bags 40. Alternatively, if a customer removes an item from the downstream set-aside shelf 42*b* or one of the grocery bags 40, the itemization/security weight scale 20 may be used to determine the weight value of the item by detecting a weight decrease associated with removal of the item from the downstream set-aside shelf 42*b* or one of the grocery bags 40. The itemization/security weight scale 20 may be embodied as any known retail weight scale. One such retail weight scale which is particularly useful as the itemization/security weight scale 20 of the present invention is a model number 6680 weight scale which is commercially available from Weigh-Tronix, Incorporated of Santa Rosa, Calif.

From the above discussion, it should be appreciated that the itemization/security weight scale 20 monitors placement of items into, and removal of items from, a downstream area 17 associated with the self-service checkout terminal 10. What is meant herein by the term "downstream area" is the area associated with the self-service checkout terminal 10 in which items may be placed (1) subsequent to being scanned or manually entered into the terminal 10, or (2) in order to have the weight value of the item determined by the itemization/security weight scale 20 for the purpose of entering the item into the self-service checkout terminal 10. For example, the downstream area 17 includes the downstream set-aside shelf 42*b* and the bagwell 38 (including the grocery bags 40 therein).

Hence, from above description, it should be appreciated that the itemization/security weight scale 20 is configured to perform both an itemization function and a security function. In particular, if a customer has an item, such as a produce item, which is sold based on the weight of the item, the itemization/security weight scale 20 may be utilized to determine the weight value associated with the item for purposes of calculating the price of the item. In particular, if the customer desires to enter an item such as a produce item, the customer may place the item either (1) on downstream set-aside shelf 42*b*, or (2) into one of the grocery bags 40 positioned in the bagwell 38. Once the itemization/security weight scale 20 has determined the weight value of the item for purchase, the customer may enter a product identification code associated with the item via use of either the keypad 34 or the touch screen associated with the display monitor 32. Thereafter, the processing unit 26 utilizes the entered product identification code to retrieve the unit price associated with the item from a product database in order to calculate the price of the item being entered. It should be appreciated that the self-service checkout terminal 10 may be configured to require the customer to execute one or more keystrokes in order to initiate a product entry sequence for entering items which are sold by weight. Alternatively the itemization/security weight scale 20 may preferably be configured to generate a trigger signal which, when received by the processing unit 26, initiates the product entry sequence for entering items which are sold by weight thereby eliminating the need for the customer to execute a keystroke procedure prior to entry of the item.

It should be appreciated that in order to perform the itemization function described above, the itemization/security weight scale 20 must be certified as a "legal" weight scale. In particular, in order to assure that the itemization/security weight scale 20 generates accurate weight values in order to assure that the customer is being charged the proper amount for his or her items for purchase, the itemization/security weight scale 20 may need to be certified by a governmental agency within the municipality in which the self-service checkout terminal 10 is located.

Moreover, as indicated above, the itemization/security weight scale 20 is also utilized to perform a security function. In particular, the itemization/security weight scale 20 is utilized to determine when an item has been placed into or removed from the downstream area 17 (i.e. placed on or removed from the downstream set-aside shelf 42*b* or placed into or removed from one of the grocery bags 40 positioned in the bagwell 38). If the item placed in the downstream area 17 is an entered item, the itemization/security weight scale 20 may be utilized to determine the weight value associated with the entered item. What is meant herein by the term "entered item" is an item that has been previously entered into the self-service checkout terminal via use of the scanner 14, the keypad 34, the touch screen associated with the display monitor 32, or other entry device.

It should be appreciated that the self-service checkout terminal 10 may utilize the weight value associated with an entered item for numerous reasons associated with providing security to the terminal 10. For example, the self-service checkout terminal 10 may compare the measured weight value of an entered item to a known weight value associated with the item that is stored in a weight database so as to prevent the customer from scanning a first item and then placing a second item of greater value (and presumably of a different weight value) into one of the grocery bags 40. The self-service checkout terminal 10 may also utilize the detected weight value of an entered item to determine if the customer removes the same item from the grocery bags 40 if the customer subsequently voids the item from his or her checkout transaction. For example, if the customer scans a can of soup, the weight value of the soup is detected when the soup is placed in the downstream area 17 (e.g. into one of the grocery bags 40). Later, if the customer voids the can of soup from his or her checkout transaction, the self-service checkout terminal 10 monitors the weight value of the item removed from the grocery bags 40 to confirm that the weight value of the item removed from the grocery bags 40 is the same as the detected weight value of the can of soup.

It should be appreciated that the above-described security reasons for monitoring the weight value associated an entered item placed into or removed from the downstream area 17 are exemplary in nature and that numerous other security reasons for monitoring the weight value associated with an entered item placed into or removed from the downstream area may be readily apparent to one skilled in the art. For example, it should be further appreciated that the itemization/security weight scale 20 may be used to monitor movement or shuffling of entered items within the downstream area 17. In particular, the itemization/security weight scale 20 may be used to monitor movement of entered items between the downstream set-aside shelf 42*b* and the grocery bags 40 within the bagwell 38. For instance, the itemization/security weight scale 20 may be used to monitor movement of entered items which had been previously set-aside on the downstream set-aside shelf 42*b* and thereafter either placed into one of the grocery bags 40 or removed permanently from the self-service checkout terminal 10 (e.g. placed in the customer's pocket). In particular, the itemization/security weight scale 20 may be used to first determine that an entered item has been removed from the downstream set-aside shelf 42*b* by detecting a weight decrease associated with removal of the entered item. Thereafter, the itemization/security weight scale 20 may be used to determine if the entered item is then placed into one of the grocery bags 40 by detecting a weight increase associated with placement of the entered item into one of the grocery bags 40.

Moreover, the itemization/security weight scale 20 may be utilized to detect placement of unentered items for purchase into the downstream area 17. What is meant herein by the term "unentered item" is an item that has not been scanned with the scanner 14, manually input with the keypad 34 or the touch screen associated with the display monitor 32, or otherwise entered into the self-service checkout terminal 10 prior to being placed on the downstream shelf 42*b* or into one of the grocer bags 40 located in the bagwell 38. It should be appreciated that the unentered item may be an item such as a produce item which is placed on the downstream set-aside shelf 42*b* or into one of the grocer bags 40 located in the bagwell 38 for the purpose of determining the weight value associated with the item so as to enter the item into the self-service checkout terminal 10 in the manner described above. Alternatively, the unentered item may be an item that was either unintentionally or intentionally placed on the downstream set-aside shelf 42*b* or into one of the grocery bags 40 located in the bagwell 38 in an effort to commit an impropriety such as theft. As shall be discussed below in greater detail, the self-service checkout terminal 10 is configured so as to allow a customer to place an unentered item on the downstream set-aside shelf 42*b* or into one of the grocer bags 40 located in the bagwell 38 for the purpose of entering the item, but prevent the customer from placing an unentered item on the downstream shelf 42*b* or into one of the grocer bags 40 located in the bagwell 38 for the purpose of committing an impropriety such as theft.

The display monitor 32 displays instructions which serve to guide a customer through a checkout procedure. For example, an instruction is displayed on the display monitor 32 which instructs the customer to remove an item from a grocery cart and enter the item into the self-service checkout terminal 10 by passing the item over the scanner 14, or placing the item on the downstream shelf 42*b* or into one of the grocer bags 40 located in the bagwell 38 in order to obtain the weight of the item. The display monitor 32 is preferably a known touch screen monitor which can generate data signals when certain areas of the screen are touched by a customer.

Figure 3:
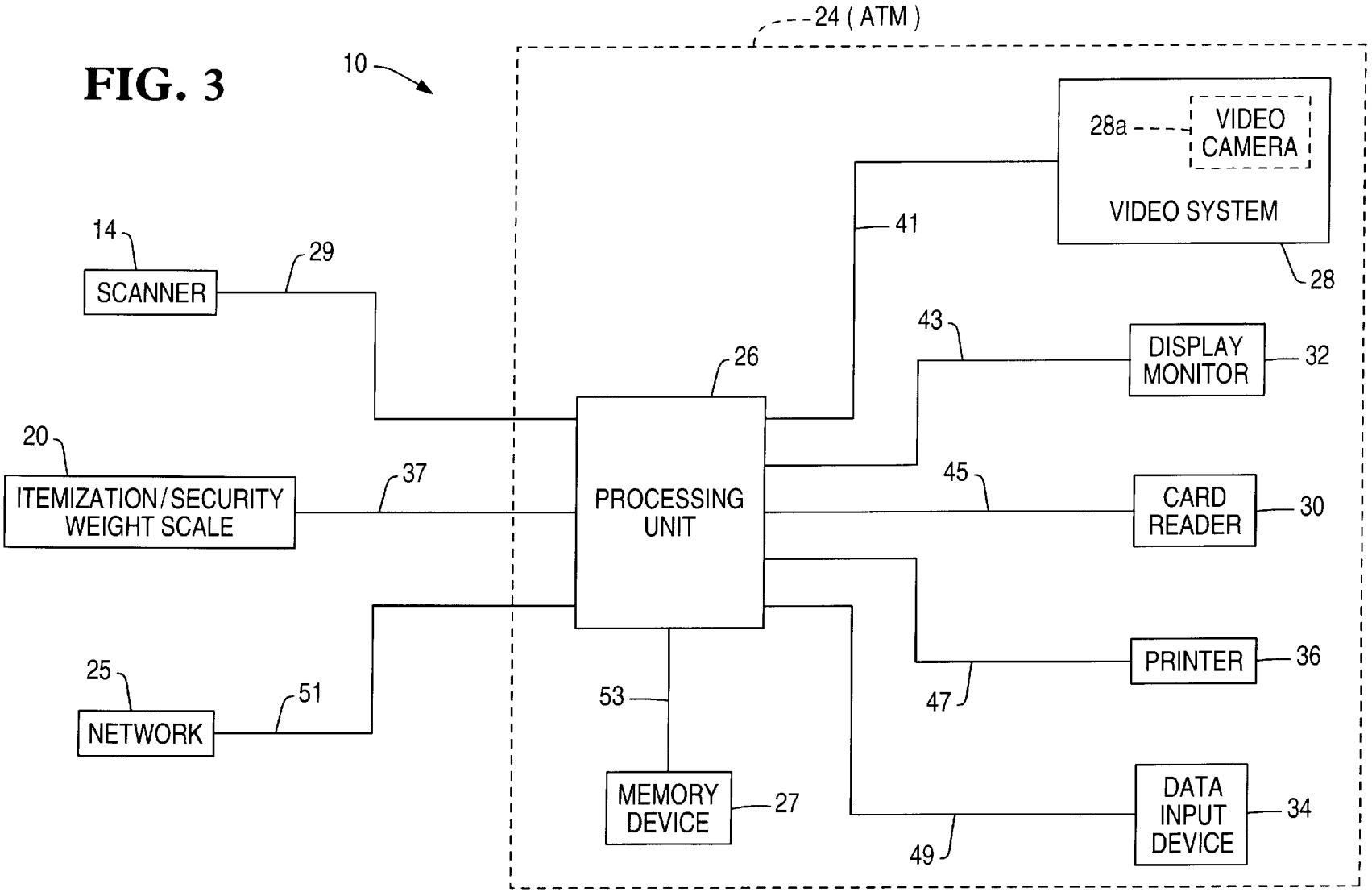
FIG. 3 is a simplified block diagram of the self-service checkout terminal of FIG. 1.

Referring now to FIG. 3, there is shown a simplified block diagram of the self-service checkout terminal 10. The processing unit 26 is electrically coupled to the scanner 14, the itemization/security weight scale 20, the video system 28, the card reader 30, the display monitor 32, the keypad 34, and the printer 36. The processing unit 26 is also electrically coupled to a network 25 and a memory device 27 as shown in FIG. 3.

The processing unit 26 monitors output signals generated by the scanner 14 via a communication line 29. In particular, when the customer of the self-service checkout terminal 10 scans an item which includes a bar code across the scanning windows 14*a*, 14*b*, an output signal is generated on the communication line 29 indicative of the product identification code associated with the item.

The processing unit 26 is coupled to the itemization/security weight scale 20 via a data communication line 37. In particular, when an item is placed on the downstream set-aside shelf 42*b* or into one of the grocery bags 40, the itemization/security weight scale 20 generates an output signal on the data communication line 37 indicative of the weight increase associated with placement of the item. Similarly, when an item is removed from the downstream set-aside shelf 42*b* or one of the grocery bags 40, the itemization/security weight scale 20 generates an output signal on the data communication line 37 indicative of the weight decrease associated with removal of the item.

The processing unit 26 communicates with the video system 28 via a communication line 41. The video system 28 includes a video camera 28*a* (see also FIG. 1), and is included in the self-service checkout terminal 10 to enhance the security thereof. The video system 28 may be a known closed-circuit video system which displays video images on a portion of the display monitor 32 relating to certain events during a customer's transaction.

The processing unit 26 communicates with the display monitor 32 through a data communication line 43. The processing unit 26 generates output signals on the data communication line 43 which cause various instructional messages to be displayed on the display monitor 32. As discussed above, the display monitor 32 includes known touch screen technology which can generate output signals when the customer touches a particular area of the display screen associated with the display monitor 32. The signals generated by the display monitor 32 are transmitted to the processing unit 26 via the data communication line 43. It should be appreciated that the various instructional messages may also be communicated via other devices in addition to or in lieu of the display monitor 32. For example, the instructional messages may be generated with a voice generating device (not shown) or an audible tone generating device (not shown).

The keypad 34 is coupled to the processing unit 26 through a data communication line 49. The keypad 34 may include one or more of a known keypad or a touch pad. The keypad 34 and the touch screen associated with the display monitor 32 may be utilized as input devices to manually enter a product identification code associated with an item for purchase. Hence, the scanner 14, the keypad 34, and the display monitor 32 define input or code entry devices which may be utilized to input the product identification code associated with an item thereby causing the item to be entered into the self-service checkout terminal 10. It should be appreciated that numerous other types of devices may also be utilized as input devices in order to fit the needs of a given self-service checkout terminal 10.

In addition, the processing unit 26 is coupled to the printer 36 via a data communication line 47. The printer 36 may be used to print a receipt at the end of a given checkout procedure. Moreover, the card reader 30 is coupled to the processing unit through a data communication line 45. The card reader 30 may include a known credit and/or debit card reader, or a smart card reader.

The processing unit 26 includes network interface circuitry (not shown) which conventionally permits the self-service checkout terminal 10 to communicate with the network 25 such as a LAN or WAN through a wired connection 51. The processing unit 26 communicates with the network 25 during the checkout procedure in order to obtain information such as pricing information on an item being scanned or weighed, and also to verify customer credit approval when appropriate. The network interface circuitry associated with the self-service checkout terminal 10 may include a known Ethernet expansion card, and the wired connection 51 may include a known twisted-pair communication line. Alternatively, the network interface circuitry may support wireless communications with the network 25.

The processing unit 26 communicates with the memory device 27 via a data communication line 53. The memory device 27 is provided to maintain an electronic transaction table which includes a record of the product information associated with each item that is scanned, weighed, or otherwise entered during the customer's use of the self-service checkout terminal 10. For example, if the customer scans a can of soup, the description of the soup and the pricing information associated therewith is recorded in the transaction table in the memory device 27. Similarly, if the customer weighs a watermelon with the itemization/security weight scale 20 and then enters a product identification code associated with watermelon via the keypad 34, product information associated with the watermelon such as the weight value and product identification code of the watermelon is recorded in the transaction table. Moreover, if a customer entered a coupon or voucher, the information associated therewith would also be recorded in the transaction table.

It should therefore be appreciated that the sum of each of the items recorded in the transaction table (1) minus any reductions (e.g. coupons), and (2) plus any applicable taxes is the amount that the customer pays for his or her transaction. Moreover, data stored in the transaction table is printed out on the printer 36 thereby generating a receipt for the customer at the end of his or her transaction.

In operation, the processing unit 26 controls the various components associated with the self-service checkout terminal 10 in order to facilitate a customer's operation of the terminal 10 along with providing a level of security from improprieties such as theft. For example, as shall be discussed below in more detail, during operation of the self-service checkout terminal 10, the terminal 10 executes a security application which operates the terminal 10 in a manner which enhances the security from improprieties such as theft while also enhancing ease of terminal operation by the customer. In particular, when a customer scans or otherwise enters an item for purchase, the security application operates the self-service checkout terminal 10 so as to determine if the customer places the entered item in the downstream area 17. More specifically, operation of the security application in regard to prevention of improprieties such as theft is enhanced if items are entered and placed in the downstream area 17 (e.g. into one of the grocery bags 40) in sequential order (e.g. a first item is scanned, the first item is placed in a grocery bag 40, a second item in scanned, the second item is placed in the bag, etc.). Hence, if the customer scans or otherwise enters an item and thereafter places the entered item on the downstream shelf 42*b* or into one of the grocer bags 40 located in the bagwell 38 (i.e. into the downstream area 17), the processing unit 26 makes a record of the detected weight value associated with the entered item. As discussed above, the weight value associated with an entered item is particularly useful for enhancing the security associated with operation of the self-service checkout terminal 10.

If the customer desires to enter an item such as a produce item into the terminal 10 which is sold based on weight of the item, the customer is instructed (via an instruction displayed on the display monitor 32 or the like) to place the unentered item on the downstream set-aside shelf 42*b* or into one of the grocer bags 40 located in the bagwell 38 so as to allow the itemization/security scale 20 to detect the weight value of the unentered item. Once the weight value of the unentered item is detected, the customer is instructed to enter the product identification code associated with the unentered item (again, via a message displayed on the display monitor 32) in order to allow the processing unit 26 to retrieve the unit price for the unentered item. If the customer enters a product identification code, the processing unit 26 calculates the price of the item by multiplying the weight value of the item by the retrieved unit price and thereafter enters a record of the item in the electronic transaction table thereby entering the item for purchase. However, if the customer does not enter the product identification code associated with the unentered item, the processing unit 26 concludes that the customer may be attempting to commit an impropriety such as theft which results in an entry being made in an electronic security log. In certain situations the contents of the electronic security log may exceed a predetermined threshold value thereby causing the self-service checkout terminal 10 to operate a summoning device such as a status lamp or paging system so as to summon retail personnel to audit or otherwise investigate the customer's transaction.

Figure 4:
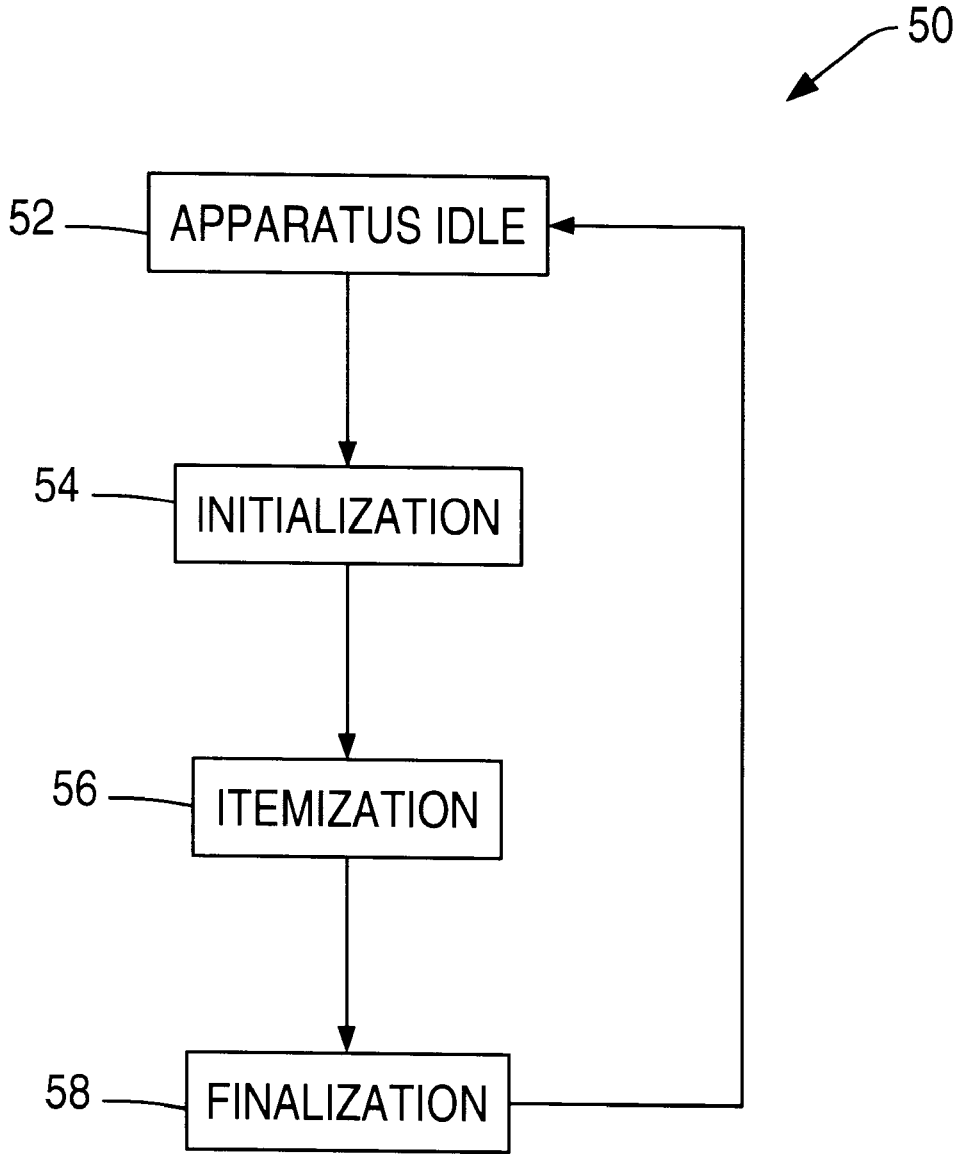
FIG. 4 is a flowchart setting forth a general procedure for checking out items through the self-service checkout terminal of FIG. 1.

Referring now to FIG. 4, there is shown a flowchart which sets forth a general procedure 50 for checking out items through the self-service checkout terminal 10. It should be appreciated that when the customer arrives at the self-service checkout terminal 10, the terminal 10 is in an idle state (step 52). An initialization step 54 is executed prior to checking out items for purchase. In particular, one or more initialization instructions are displayed on the display monitor 32 which instruct the customer to (1) touch a particular area of the display monitor 32 or push a particular button on the keypad 34 in order to select a desired method of payment, and/or (2) identify himself or herself by inserting a loyalty card, debit card, credit card, or smart card into the card reader 30.

At the completion of the initialization step 54, the routine 50 advances to an itemization step 56 where the customer enters individual items for purchase by scanning the items across the scanner 14. Moreover, in step 56, the customer may enter items, such as produce items or the like, by weighing the items with the itemization/security scale 20, and thereafter entering a product identification code associated with the item via either the keypad 34 or by touching a particular area of the display monitor 32. Further, in step 56 the customer may enter an item by manually entering the product identification code associated with the item via use of the keypad 34. Such manual entry of an item may be necessary for items (which would otherwise be entered via the scanner 14) if the product identification code printed on the item is not readable by the scanner 14 or if the item is too large or bulky to be scanned with the scanner 14. It should be appreciated that the self-service checkout terminal 10 may be configured such that the routine 50 allows experienced customers to bypass the initialization step 52 thereby advancing directly to the itemization step 56. In such a configuration, the experienced customer would begin the transaction by scanning or otherwise entering his or her first item for purchase.

At the completion of the itemization step 56, the routine 50 advances to a finalization step 58 in which (1) a grocery receipt is printed by the printer 36, and (2) payment is tendered by either inserting currency into a cash acceptor (not shown), charging a credit card or debit card account, or decreasing a value amount stored on a smart card via the card reader 30. It should be appreciated that in the case of when a customer inserts currency into the cash acceptor, the self-service checkout terminal 10 may provide change via a currency dispenser (not shown) and a coin dispenser (not shown). After completion of the finalization step 58, the routine 50 returns to step 52 in which the self-service checkout terminal 10 remains in the idle condition until a subsequent customer initiates a checkout procedure.

Figure 5:
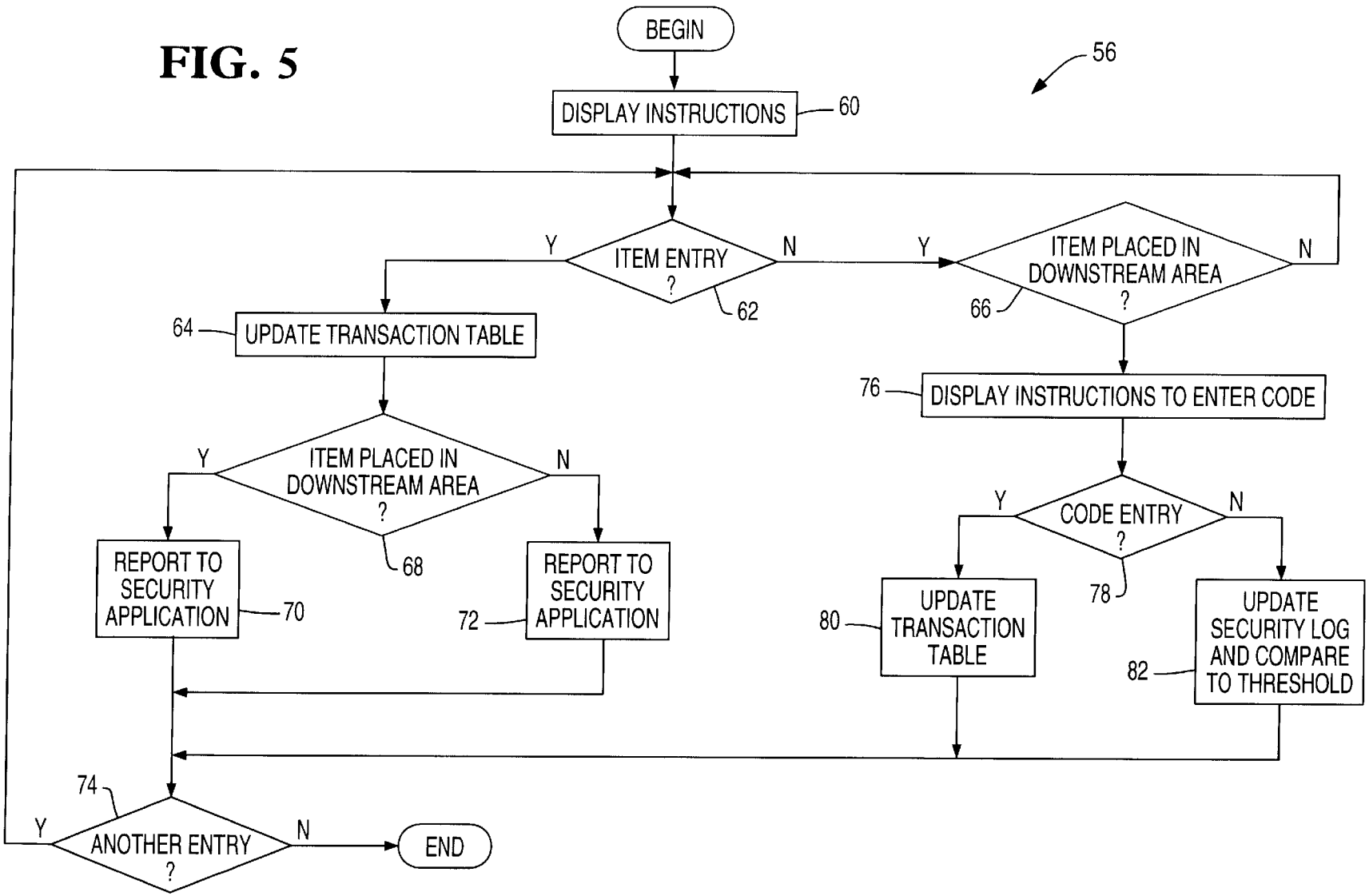
FIG. 5 is a flowchart setting forth in more detail the itemization step of the general procedure of FIG. 4.

Referring now to FIG. 5, there is shown a flowchart setting forth the itemization step 56 in greater detail. After the initialization step 54 (see FIG. 4) is completed, the routine 56 advances to step 60 in which a message is displayed on the display monitor 32 which instructs the customer to enter an item by either (1) passing or otherwise scanning individual items across or adjacent the scanner 14 with the item's product identification code facing the scanning windows 14*a*, 14*b*, (2) placing an individual item on the on the downstream set-aside shelf 42*b* or into one of the grocery bags 40 in order to be weighed, or (3) manually entering the product identification code associated with an item with the keypad 34 or the touch screen associated with the display monitor 32. The routine 56 then advances to step 62.

In step 62, the processing unit 26 determines whether an item has been entered into the self-service checkout terminal 10 via use of the scanner 14, the keypad 34, or the touch screen associated with the display monitor 32. In particular, the processing unit 26 determines if (1) the scanner 14 has successfully read or otherwise captured the product identification code associated with an item, (2) the product identification code associated with an item has been entered via the touch screen portion of the display monitor 32, or (3) the product identification code associated with an item has been entered via the keypad 34. More specifically, the scanner 14 generates an output signal which is sent to the processing unit 26 once the scanner 14 successfully reads the product identification code associated with the item. Similarly, the display monitor 32 and the keypad 34 generate an output signal which is sent to the processing unit 26 once the product identification code has been entered by the customer. If an item is successfully entered into the self-service checkout terminal 10, an item-entered control signal is generated and the routine 56 advances to step 64. If an item is not successfully entered into the self-service checkout terminal 10, the item-entered control signal is not generated, and the routine 56 advances to step 66.

In step 64, the processing unit 26 adds a record of the entered item (i.e. the item that was entered in step 62) to the transaction table. In particular, the processing unit 26 communicates with the network 25 to obtain product information (e.g. description and price) associated with the entered item from a master product database. Thereafter, the processing unit 26 updates the transaction table. More specifically, the processing unit 26 generates an output signal which causes the transaction table to be updated to include the product information associated with the entered item. It should be appreciated that the contents of the transaction table are used by the self-service checkout terminal 10 for purposes of generating a grocery bill and receipt at the end of the transaction. The routine 56 then advances to step 68.

In step 68, the processing unit 26 determines if the entered item is placed into the downstream area 17 of the self-service checkout terminal 10. More specifically, the itemization/security weight scale 20 generates an output signal which is sent to the processing unit 26 once the itemization/security weight scale 20 has detected the customer placing the entered item into one of the grocery bags 40. Moreover, the customer may opt not to immediately place the entered item into one of the grocery bags 40. For example, if the customer scanned a loaf of bread, the customer may wait to place the bread into one of the grocery bags 40 until it is nearly full thereby preventing the bread from being crushed. Hence, in step 68 the itemization/security weight scale 20 generates an output signal which is sent to the processing unit 26 once the itemization/security weight scale 20 has detected a customer placing the entered item onto the downstream set-aside shelf 42*b*. Therefore, if the customer places the entered item in the downstream area 17 (i.e. into one of the grocery bags 40 or onto the downstream set-aside shelf 42*b*), an entered-item-detected control signal is generated and the routine 56 advances to step 70. However, if the customer does not place the entered item in the downstream area 17 within a predetermined period of time, the entered-item-detected control signal is not generated and the routine 56 advances to step 72.

In step 70, the processing unit 26 reports the placement of the entered item into the downstream area 17 (and hence the weight value of the entered item) to the security application. As alluded to above, the security application may be configured to compare the detected weight value of the entered item (as detected by the itemization/security weight scale 20) to a known weight value of the entered item to determine if the customer has placed the proper item (i.e. the same item that was entered in step 62) into the downstream area 17. Moreover, the detected weight value may be utilized to build a weight database which includes the weight values of previously entered items. Such a weight database is particularly useful, for example, in the case monitoring removal of the proper item during a voiding procedure. It should be appreciated that the above-described security reasons for monitoring the weight value associated an entered item being placed in the downstream area 17 are exemplary in nature and that numerous other security reasons for monitoring the weight value associated with an entered item being placed in the downstream area 17 may be readily apparent to one skilled in the art. Once the weight value of the entered item has been reported to the security application, the routine 56 advances to step 74.

In step 74, the processing unit 26 monitors output from the keypad 34 and the display monitor 32 in order to determine whether there are more items to be entered. In particular, a message is displayed on the display monitor 32 instructing the customer to touch a particular touch screen area of the display monitor 32, or to touch a particular key associated with the keypad 34, when the customer has completed entering all of his or her items for purchase.

If a particular output is detected from either the keypad 34 or the display monitor 32, the processing unit 26 determines that the itemization step 56 is complete and the routine 56 then ends thereby advancing the routine 50 (see FIG. 4) to the finalization step 58 in order to allow the customer to tender payment for his or her items for purchase. If a particular output is not detected from either the keypad 34 or the display monitor 32, the processing unit 26 determines that the customer has additional items for purchase to be entered, and the routine 56 loops back to step 62 to monitor entry of subsequent items.

Returning now to step 68, if the customer does not place the entered item in the downstream area 17 within a predetermined period of time, the routine 56 advances to step 72. In step 72, the processing unit 26 reports the lack of placement of the entered item into the downstream area 17 to the security application. As described above, the configuration of the self-service checkout terminal 10 does not require that every entered item be placed in the downstream are 17. For example, if the customer scans a pack of gum, the self-service checkout terminal 10 is configured to allow the customer to place the pack of gum in his or her pocket as opposed to requiring the customer to place the gum into one of the grocery bags 40. However, as discussed above, certain security advantages are achieved by having as many entered items as possible placed in the downstream area 17. Hence, in step 72, the processing unit 26 reports lack of placement of the entered item into the downstream area 17 to the security application. The security application may be configured so as to utilize such information in a variety of manners based on the needs of a given retailer. For example, if the security application determines that more than a predetermined number of entered items have not been placed in the downstream area 17, the retailer may desire to have the customer's transaction audited or otherwise investigated. Once the lack of placement of the entered item into the downstream area 17 has been reported to the security application, the routine 56 advances to step 74 to determine if the customer has additional items to enter in the manner previously discussed.

Returning now to step 62, if an item is not successfully entered into the self-service checkout terminal 10, the routine 56 advances to step 66. In step 66, the processing unit 26 determines if an unentered item has been placed into the downstream area 17 of the self-service checkout terminal 10. More specifically, the itemization/security weight scale 20 generates an output signal which is sent to the processing unit 26 once the itemization/security weight scale 20 has detected the customer placing an unentered item into one of the grocery bags 40 or onto the downstream set-aside shelf 42*b*. Therefore, if the customer places an unentered item in the downstream area 17 (i.e. into one of the grocery bags 40 or onto the downstream set-aside shelf 42*b*), an unentered-item-detected control signal is generated and the routine 56 advances to step 76. However, if the customer does not place an unentered item in the downstream area 17, the processing unit 26 concludes that there is no present attempt being made by the customer to enter an item for purchase into the self-service checkout terminal 10 and the routine 56 loops back to step 62 to monitor subsequent item entry.

In step 76, the processing unit 26 generates a message which is displayed on the display monitor 32 which instructs the customer to enter a product identification code associated with the unentered item with an input device associated with the self-service checkout terminal. In particular, a message is displayed on the display monitor 32 which instructs the customer to enter the product identification code associated with the unentered item by use of either the keypad 34 or the touch screen associated with the display monitor 32. Once the instruction has been displayed on the display monitor 32, the routine 56 advances to step 78.

In step 78, the processing unit 26 determines whether a product identification code associated with the unentered item has been entered via use of the keypad 34, the touch screen associated with the display monitor 32, or any other input device associated with the terminal 10. In particular, the keypad 34 and/or the display monitor 32 generate an output signal which is sent to the processing unit 26 once the product identification code has been entered by the customer. If a product identification code is entered into the self-service checkout terminal 10, a code-entered control signal is generated and the routine 56 advances to step 80. If a product identification code is not entered into the self-service checkout terminal 10 within a predetermined period of time, the code-entered control signal is not generated, and the routine 56 advances to step 82.

In step 80, the processing unit 26 concludes that the unentered item that was placed in the downstream area 17 is an item such as a produce item that is sold by weight since the customer subsequently entered a product identification code associated with the item. Hence, in step 80, the processing unit 26 adds a record of the item that was entered in step 78 to the transaction table. In particular, the processing unit 26 communicates with the network 25 to obtain product information (e.g. description and price) associated with the item from a master product database. Thereafter, the processing unit 26 updates the transaction table. More specifically, the processing unit 26 generates an output signal which causes the transaction table to be updated to include the product information associated with the item such as the weight value of the item along with the product identification code associated with the item. It should be appreciated that the contents of the transaction table are used by the self-service checkout terminal 10 for purposes of generating a grocery bill and receipt at the end of the transaction. The routine 56 then advances to step 74 to determine if the customer has additional items for purchase in the manner previously discussed.

Returning now to step 78, if a product identification code is not entered into the self-service checkout terminal 10 within a predetermined period of time, the routine 56 advances to step 82. In step 82, the processing unit 26 determines that an unentered item has been improperly placed in the downstream area 17. This is true since the itemization/security scale 20 detected placement of an unentered item into the downstream area 17, but the customer did not subsequently enter a product identification code corresponding with the item so as to allow the item to be entered into the customer's checkout transaction. Hence, in step 82, the processing unit 26 increments an electronic security log value. More specifically, the processing unit 26 generates an output signal which causes an electronic security log value maintained in the memory device 27 to be incremented by a value of one. It should be appreciated that such an electronic security log may also have entries made therein based on other behavioral patterns of the customer such as placing earlier items in a grocery bag 40 which have not been entered or other types of inadvertent or intentional security breaches.

Thereafter, the processing unit 26 determines if the updated security log value has a predetermined relationship with a log threshold value. More specifically, if the updated log value exceeds a predetermined log threshold value, the processing unit 26 causes an personnel-needed control signal to be generated which in turn pages or otherwise summons retail personnel such as a customer service manager or other security personnel in order to audit or otherwise investigate the customer's transaction. It should be appreciated that retail personnel may be summoned via use of a summoning device such as a paging network or a signal lamp. Moreover, it should be further appreciated that retail personnel may be summoned upon the first occurrence of an unentered item being placed in the downstream area 17 without the unentered item being subsequently entered (as opposed to tallying such occurrences in the security log). Moreover, the customer's transaction may be suspended until the customer's transaction is audited or otherwise investigated by retail personnel. If the customer's transaction is allowed to continue, the routine 56 then advances to step 74 in order to determine if the customer has additional items to enter in the manner previously discussed.

Hence as described herein, the self-service checkout terminal 10 of the present invention provides numerous advantages over terminals which have heretofore been designed. For example, the self-service checkout terminal 10 of the present invention utilizes a single weight scale (i.e. the itemization/security weight scale 20) to perform both an itemization function (e.g. entering produce items) and a security function (e.g. preventing unentered items from being placed in a grocery bag). Such use of a single weight scale to perform such functions reduces costs associated with manufacturing the self-service checkout terminal 10. Moreover, the self-service checkout terminal 10 of the present invention facilitates ease of customer use and enhanced throughput by eliminating the need for the customer to place an item such as a produce item on a dedicated product scale in order to determine the weight value of the item for itemization purposes and thereafter remove the item for subsequent placement into one of the grocery bags 40. By contrast, the produce item may be placed directly into a grocery bag 40 in order to determine the weight value thereof for itemization purposes.

While the invention has been illustrated and described in detail in the drawings and foregoing description, such an illustration and description is to be considered as exemplary and not restrictive in character, it being understood that only the preferred embodiment has been shown and described and that all changes and modifications that come within the spirit of the invention are desired to be protected.

There are a plurality of advantages of the present invention arising from the various features of the self-service checkout terminal described herein. It will be noted that alternative embodiments of the self-service checkout terminal of the present invention may not include all of the features described yet still benefit from at least some of the advantages of such features. Those of ordinary skill in the art may readily devise their own implementations of a self-service checkout terminal that incorporate one or more of the features of the present invention and fall within the spirit and scope of the present invention as defined by the appended claims.

What is claimed is:

1. A method of operating a self-service checkout terminal having a weight scale associated therewith, comprising the steps of:

detecting placement of an entered item for purchase into a shopping container with said weight scale and generating an entered-item-detected control signal in response thereto;

operating said self-service checkout terminal so as to allow a user to enter subsequent items for purchase in response to generation of said entered-item-detected control signal;

detecting placement of an unentered item for purchase into said shopping container with said weight scale and generating an unentered-item-detected control signal in response thereto;

operating said self-service checkout terminal so as to allow said user to enter said unentered item for purchase into said self-service checkout terminal in response to generation of said unentered-item-detected control signal;

determining a weight value associated with said unentered item for purchase with said weight scale;

determining if said user operates an input device so as to input an identification code associated with said unentered item for purchase and generating a code-entered control signal in response thereto; and entering a record in a transaction table in response to generation of said code-entered control signal, said record including (i) said weight value of said unentered item for purchase, and (ii) said identification code of said unentered item for purchase.

2. The method of claim.1, further comprising the steps of:

generating a personnel-needed control signal if said user does not operate said input device so as to input said identification code associated with said unentered item for purchase; and operating a summoning device so as to summon retail personnel in response to generation of said personnel-needed control signal.

3. The method of claim 1, further comprising the steps of:

generating an item-entered control signal when said user enters said entered item for purchase; and entering a record corresponding to said entered item for purchase in a transaction table in response to generation of said item-entered control signal, wherein said step of detecting placement of said entered item for purchase into said shopping container with said weight scale includes the step of monitoring output from said weight scale in response to generation of said item-entered control signal so as to detect placement of said entered item for purchase into said shopping container with said weight scale.

4. The method of claim 1, wherein:

said shopping container is a grocery bag, and said weight scale is positioned so as to measure a weight value associated with contents of said grocery bag.

5. The method of claim 1, wherein:

said self-service checkout terminal includes a bagwell, and said weight scale is positioned so as to detect placement of said entered item for purchase and said unentered item for purchase into said shopping container when said shopping container is positioned in said bagwell.

6. A method of operating a self-service checkout terminal having a weight scale associated therewith, comprising the steps of:

generating an item-entered control signal when a user enters a first item for purchase with a code entry device;

monitoring output from said weight scale in response to generation of said item-entered control signal and generating an entered-item-detected control signal if said weight scale detects that said user placed said first item for purchase in a shopping container;

operating said self-service checkout terminal so as to allow said user to enter subsequent items for purchase in response to generation of said entered-item-detected control signal;

generating an unentered-item-detected control signal if said weight scale detects that said user placed a second item for purchase in said shopping container without having entered said second item for purchase into said self-service checkout terminal;

operating said self-service checkout terminal so as to allow said user to enter said second item for purchase into said self-service checkout terminal in response to generation of said unentered-item-detected control signal;

determining a weight value associated with said second item for purchase with said weight scale;

determining if said user operates an input device so as to input an identification code associated with said second item for purchase and generating a code-entered control signal in response thereto; and entering a record in a transaction table in response to generation of said code-entered control signal, said record including (i) said weight value of said second item for purchase, and (ii) said identification code of said second item for purchase.

7. The method of claim 6, further comprising the steps of:

generating a personnel-needed control signal if said user does not operate said input device so as to input said identification code associated with said second item for purchase; and operating a summoning device so as to summon retail personnel in response to generation of said personnel-needed control signal.

8. The method of claim 6, further comprising the steps of:

generating an item-entered control signal when said user enters said first item for purchase; and entering a record corresponding to said first item for purchase in a transaction table in response to generation of said item-entered control signal, wherein said step of detecting placement of said first item for purchase into said shopping container with said weight scale includes the step of monitoring output from said weight scale in response to generation of said item-entered control signal so as to detect placement of said first item for purchase into said shopping container with said weight scale.

9. The method of claim 6, wherein:

said shopping container is a grocery bag, and said weight scale is positioned so as to measure a weight value associated with contents of said grocery bag.

10. The method of claim 6, wherein:

said self-service checkout terminal includes a bagwell, and said weight scale is positioned so as to detect placement of said first item for purchase and said second item for purchase into said shopping container when said shopping container is positioned in said bagwell.

11. A self-service checkout terminal, comprising:

an input device;

a weight scale for detecting placement of both an entered item for purchase and an unentered item for purchase into a shopping container;

a processing unit electrically coupled to said weight scale; and a memory device electrically coupled to said processing unit, wherein said memory device has stored therein a plurality of instructions which, when executed by said processing unit, causes said processing unit to:

(a) detect placement of said entered item for purchase into said shopping container with said weight scale and generate an entered-item-detected control signal in response thereto, (b) operate said self-service checkout terminal so as to allow a user to enter subsequent items for purchase in response to generation of said entered-item-detected control signal, (c) detect placement of said unentered item for purchase into said shopping container with said weight scale and generate an unentered-item-detected control signal in response thereto, (d) operate said self-service checkout terminal so as to allow said user to enter said unentered item for purchase into said self-service checkout terminal in response to generation of said unentered-item-detected control signal, (e) determine a weight value associated with said unentered item for purchase with said weight scale, (f) determine if said user operates said input device so as to input an identification code associated with said unentered item for purchase and generate a code-entered control signal in response thereto, and (g) enter a record in a transaction table in response to generation of said code-entered control signal, said record including (i) said weight value of said unentered item for purchase, and (ii) said identification code of said unentered item for purchase.

12. The self-service checkout terminal of claim 11, further comprising a summoning device, wherein said plurality of instructions, when executed by said processing unit, further causes said processing unit to:

(a) generate a personnel-needed control signal if said user does not operate said input device so as to input said identification code associated with said unentered item for purchase; and (b) operate said summoning device so as to summon retail personnel in response to generation of said personnel-needed control signal.

13. The self-service checkout terminal of claim 11, wherein said plurality of instructions, when executed by said processing unit, further causes said processing unit to:

(a) generate an item-entered control signal when said user enters said entered item for purchase, (b) enter a record corresponding to said entered item for purchase in a transaction table in response to generation of said item-entered control signal, and (c) monitor output from said weight scale in response to generation of said item-entered control signal so as to detect placement of said entered item for purchase into said shopping container with said weight scale.

14. The self-service checkout terminal of claim 11, wherein:

said shopping container is a grocery bag, and said weight scale is positioned so as to measure a weight value associated with contents of said grocery bag.

15. The self-service checkout terminal of claim 11, further comprising a bagwell, wherein said weight scale is positioned so as to detect placement of said first item for purchase and said second item for purchase into said shopping container when said shopping container is positioned in said bagwell.

* * * * *